United States Patent [19]

Stanley, Jr.

[11] 4,303,036

[45] Dec. 1, 1981

[54] DAMAGE CONTROL CRAFT

[76] Inventor: John P. Stanley, Jr., 67 Wandell Ave., Staten Island, N.Y. 10304

[21] Appl. No.: 126,536

[22] Filed: Mar. 3, 1980

[51] Int. Cl.[3] ..... B63B 43/16

[52] U.S. Cl. ..... 114/227

[58] Field of Search ..... 114/197, 222, 227, 228, 114/229

[56] References Cited

U.S. PATENT DOCUMENTS

| | | | |
|---|---|---|---|
| 1,079,208 | 11/1913 | Browne | 114/222 |
| 2,446,190 | 8/1948 | Oding | 114/227 |
| 4,051,797 | 10/1977 | Hausmann | 114/222 X |
| 4,161,155 | 7/1979 | Cloutier | 114/227 |

*Primary Examiner*—William A. Cuchlinski, Jr.
*Attorney, Agent, or Firm*—Daniel Jay Tick

[57] ABSTRACT

A container has an air tank therein occupying some of the space in the container. A projecting part extends from the container and has an open end coupled to the air tank via an air duct. A hole-filling member is mounted at the open end of the projecting part. A pump in the container selectively pumps sea water into the container and out of the container for maneuvering the container beneath the hull of a damaged sea vessel to position the hole-filling member of the projecting part in a hole in the bottom of the hull. Compressed air is supplied to the air tank to control the buoyance of the container and for expanding the hole-filling member in the hole in the hull to plug the hole.

2 Claims, 4 Drawing Figures

DAMAGE CONTROL CRAFT

BACKGROUND OF THE INVENTION

The present invention relates to a damage control craft. More particularly, the invention relates to a damage control craft for plugging a hole in the bottom of the hull of a sea vessel below the water line, the sea vessel having a hull damaged due to a hole in the bottom of the hull below the water line.

Seagoing vessels often have their hulls punctured below the water line due to accident, and are not only in danger of sinking, but, when carrying oil, and the like, are apt to pollute a large area around them. If the hole in the hull cannot be filled from inside the vessel, the vessel may be saved from sinking and oil and the like may be prevented from leaking by filling the hole from outside the vessel.

Objects of the invention are to provide a damage control craft of simple structure, which is inexpensive in manufacture, used with facility and convenience, and functions efficiently, effectively and reliably to fill or plug a hole in the hull of a seagoing vessel, beneath the water line, and thereby prevent the foundering of the vessel and the leakage of oil, or the like, from the vessel into the waters around it.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 3:
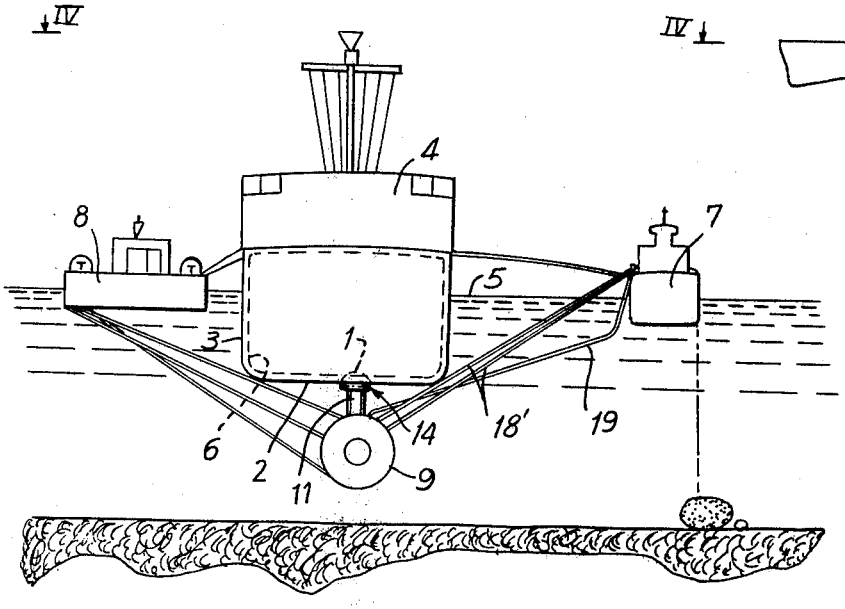
FIG. 3 is a schematic diagram illustrating the positioning of the salvage vessels and the damage control craft of the invention beneath a stricken vessel to plug a hole in the hull of the vessel beneath the water line.

The damage control craft of the invention plugs a hole 1 in the bottom 2 of the hull 3 of a sea vessel 4 below the water line 5 (FIG. 3). The sea vessel 4 has a hull 3 damaged due to the hole 1 in the bottom 2 of said hull below the water line 5 (FIG. 3). If the vessel 4 is a tanker, it contains a tank 6 (FIG. 3) with oil or the like therein, and if its hull is punctured at said tank, so that said tank is also punctured, the oil or the like escapes from the vessel and pollutes the area therearound.

Figure 4:
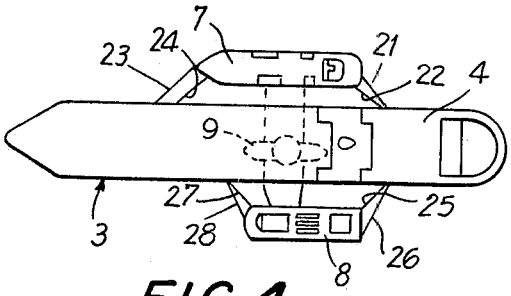
FIG. 4 is a schematic diagram illustrating the positions of the salvage vessels and the damage control craft of the invention in plugging a hole in the hull of a seagoing vessel.

The damage control craft of the invention is utilized with a tender 7 (FIGS. 3 and 4) and a barge 8 (FIGS. 3 and 4). The tender 7 is tied to one side of the vessel 4 and the barge 8 is tied to the opposite side of said vessel, as shown in FIGS. 3 and 4, and the damage control craft of the invention is maneuvered beneath the damaged vessel under the control of personnel aboard the tender and barge. The barge 8 may be used to remove the oil, or the like, from the tank 6 and store same during the period that the hole 1 is being plugged by the damage control craft of the invention.

Figure 1:
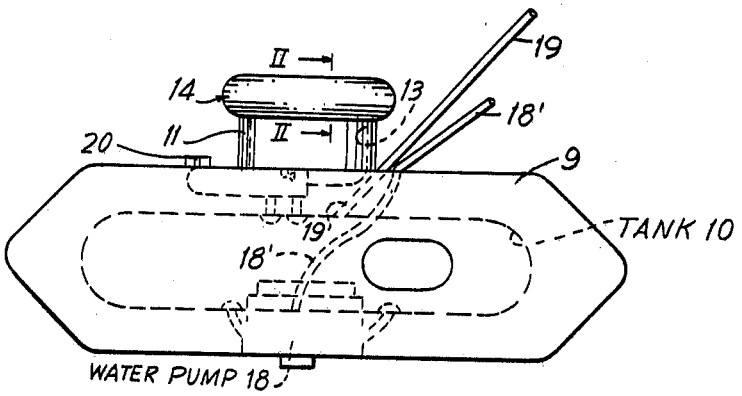
FIG. 1 is a side view of an embodiment of the damage control craft of the invention.

The damage control craft of the invention comprises a container 9 which is of generally watertight pontoon-like configuration (FIGS. 1, 3 and 4). The container 9 has an air tank 10 therein occupying some of the space in the container, as shown in FIG. 1.

In accordance with the invention, a projecting part 11 extends from the container 9 (FIGS. 1 to 4) and has an open end 12 (FIG. 2) coupled to the air tank 10 via an air duct 13 (FIG. 1).

Figure 2:
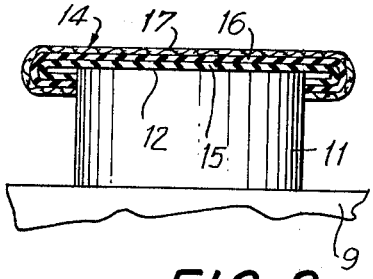
FIG. 2 is a cross-sectional view, on an enlarged scale, of an embodiment of the hole-filling member of the damage control craft of the invention.

In accordance with the invention, a hole-filling member 14 is mounted at the open end 12 of the projecting part 11, as shown in FIGS. 1 and 2. The hole-filling member 14 comprises a flexible cover, membrane, diaphragm, or the like, of waterproof materials. The waterproof materials preferably include a puncture-sealing layer 15 of rubber, covered by a layer 16 of multi-ply rubber, which, in turn, is covered by a three-ply canvas 17, as shown in FIG. 2.

A water pump 18 is provided in the container 9, as shown in FIG. 1, for selectively pumping seawater into and out of said container for maneuvering said container beneath the hull 3 of the damaged vessel 4 to position the hole-filling member 14 of the projecting part 11 in the hole 1 in the bottom 2 of said hull. The seawater pumped into the container 9 is stored in the area around the compressed air tank 10 and is used as ballast in conjunction with varying volumes of air in said air tank to control the buoyancy and level under the surface of the body of water at which the container 9 is maintained afloat. The pump 18 is energized by electrical energy supplied via electrical cables 18' to the damage control craft.

Compressed air supply equipment aboard the tender 7 supplies air to the air tank 10 of the container 9 via an air hose 19 (FIG. 1) to control the buoyancy of said container and to expand the hole-filling member 14 in the hole 1 in the hull 3 to plug said hole.

The air tank 10 is regulated further by an independent air intake valve 20 (FIG. 1). The air from the air tank 10 regulates the pressure applied to the hole-filling member 14 thereby expanding said member into the hole 1, regardless of the irregular configuration and nature of such hole.

The damage control craft of the invention is tied to the tender 7 and to the barge 8 by steel cables and is maneuvered by control of the air in its air tank 10 and the water ballast in its container 9 under the hole 1 and then permitted to rise so that the hole-filling member 14 is positioned at and in said hole. The air pressure of the air in the tank 10 is then increased to expand the hole-filling member 14 so that it functions somewhat as a balloon to fill said hole.

The tender 7 is preferably anchored, as shown in FIG. 3, and is tied to the vessel 4 via cables 21, 22, 23 and 24 (FIG. 4). The barge 8 is tied to the vessel 4 via cables 25, 26, 27 and 28 (FIG. 4).

As hereinbefore mentioned, the barge 8 may be used to remove the oil, or the like, from the tank 6 and store same during the period that the hole 1 is being plugged by the damage control craft of the invention. Actually, the barge 8 would not have the capacity to store the entire contents of the tank 6. The barge 8 thus carries machinery, including pumps, for transferring oil, or the like, to another vessel. A small volume of oil could be stored in the barge 8, however, if the barge has a tank.

While the invention has been described by means of a specific example and in a specific embodiment, I do not wish to be limited thereto, for obvious modifications will occur to those skilled in the art without departing from the spirit and scope of the invention.

I claim:

1. A damage control craft for plugging a hole in the bottom of the hull of a sea vessel below the water line, said sea vessel having a hull damaged due to a hole in the bottom of the hull below the water line, said damage control craft comprising a container having an air tank therein occupying some of the space in said container;

a projecting part extending from the container and having an open end coupled to the air tank via an air duct;

a hole-filling member mounted at the open end of the projecting part;

a pump in said container for selectively pumping seawater into said container and out of said container for maneuvering said container beneath the hull of a damaged sea vessel to position the hole-filling member of said projecting part in a hole in the bottom of said hull;

pump energizing means for energizing said pump; and compressed air supply means for supplying air to said air tank to control the buoyancy of said container and for expanding said hole-filling member in said hole in said hull to plug said hole.

2. A damage control craft as claimed in claim 1, wherein said hole-filling member comprises a flexible cover of waterproof materials.

* * * * *